United States Patent [19]

Folwell et al.

[11] Patent Number: 4,700,111

[45] Date of Patent: Oct. 13, 1987

[54] HIGH FREQUENCY BALLAST CIRCUIT

[75] Inventors: Dale E. Folwell, Placentia; Howard Handler, Westminster, both of Calif.

[73] Assignee: Intelite Inc., Placentia, Calif.

[21] Appl. No.: 891,264

[22] Filed: Jul. 28, 1986

[51] Int. Cl.[4] ..... H05B 37/02

[52] U.S. Cl. ..... 315/200 R; 315/206; 315/208; 315/224

[58] Field of Search ..... 315/224, 200 R, 206, 315/208

[56] References Cited

U.S. PATENT DOCUMENTS

| | | | |
|---|---|---|---|
| 3,703,677 | 11/1972 | Farrow | 315/254 |
| 3,999,100 | 12/1976 | Dendy | 315/208 |
| 4,042,856 | 8/1977 | Steigerwald | 315/208 |
| 4,251,752 | 2/1981 | Stolz | 315/208 |
| 4,395,659 | 7/1983 | Aolke et al. | 315/209 R |
| 4,412,154 | 10/1983 | Klein | 315/224 |
| 4,585,974 | 4/1986 | Stupp et al. | 315/224 |

*Primary Examiner*—Harold Dixon
*Attorney, Agent, or Firm*—James F. Kirk

[57] ABSTRACT

A high frequency ballast circuit powered by a dc input voltage source for starting and operating a gas discharge lamp load, comprising: a means for providing drive signals, each the drive signal having a first and second state, a series switch having a conduction channel having a first and second terminal, the series switch having a control terminal responsive to the drive signals, the conduction channel is on (conductive) in responsive to the interval characterized by the first state of the drive signal and off (non-conductive) in response to a drive signal having a second state, and an inductor. A clamp diode is included. The inductor is coupled to the clamp diode cathode and to the series switch. A ballast reactance is included with a a power oscillator circuit, the power oscillator circuit has a transformer having, a primary winding having a first, a second and a center-tap terminal, a drive winding having a first and a second and a center-tap terminal, and an output winding. A reactance tunning means coupled between the transformer primary winding first and second terminal, a first and second drive switch, the primary winding first terminal is coupled to the first drive switch, the primary winding second terminal is coupled to the second drive switch, and the primary winding center-tap is coupled to the inductor; the drive winding first and second terminal are respectively coupled to the first and second a switch control terminals. A boost circuit means, and a timer circuit operating from the boost circuit means power, and means for adjusting the duty cycle ratio of the timer circuit.

20 Claims, 11 Drawing Figures

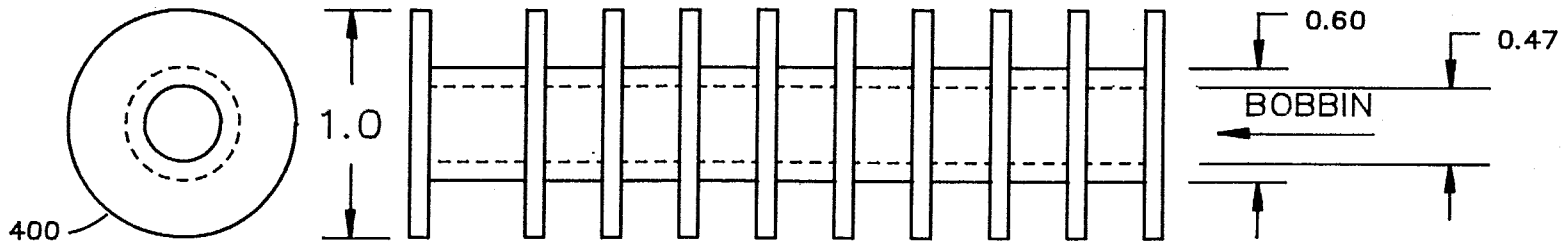
FIG. 4
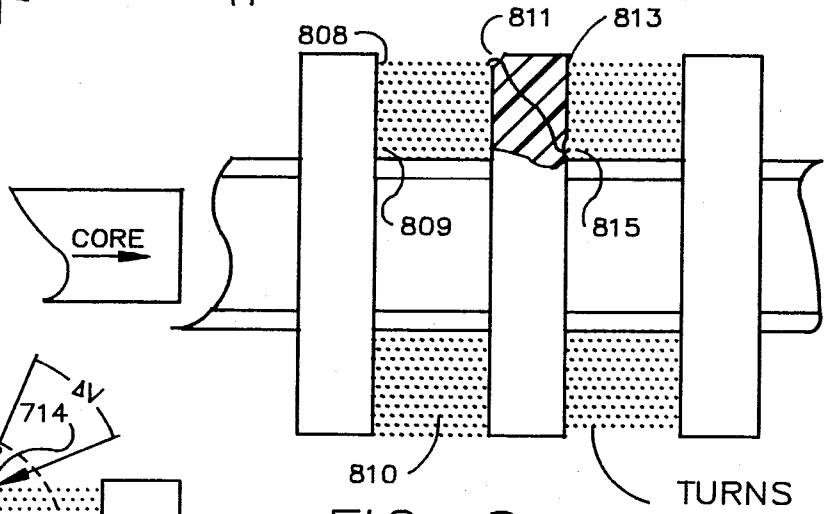
FIG. 5
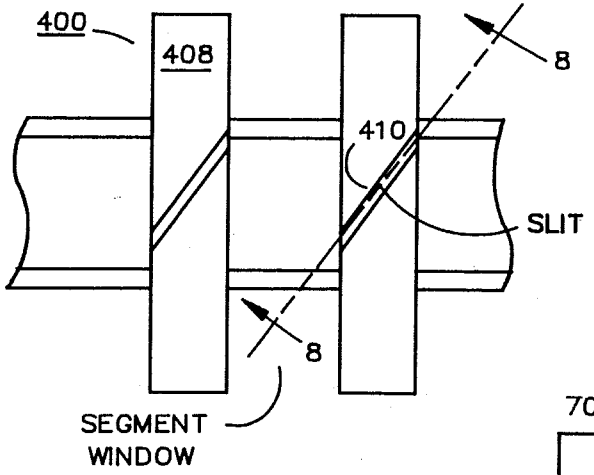
FIG. 6
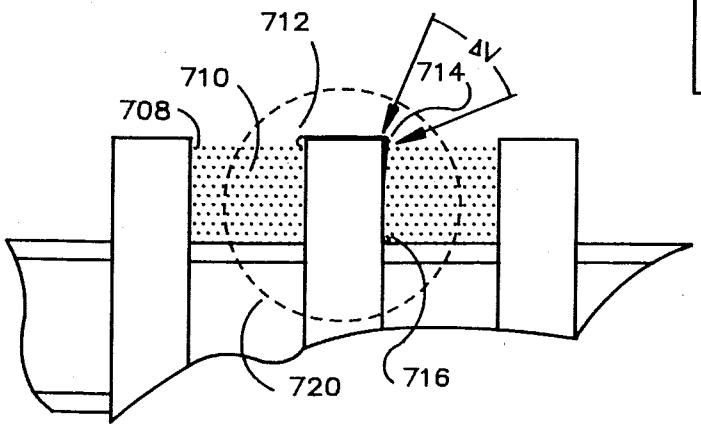
FIG. 7
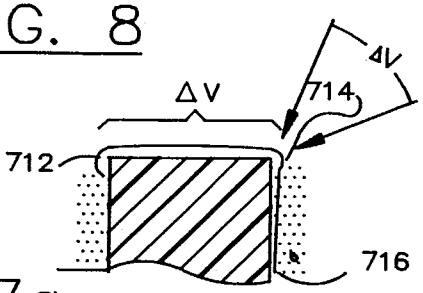
FIG. 7a
FIG. 8

HIGH FREQUENCY BALLAST CIRCUIT

BACKGROUND OF THE INVENTION

1. Field of the Invention

This invention relates to the field of neon lighting and more particularly to the field of circuits designed to convert electrical power derived from low frequency single or multi-phase ac service such as sixty cycle, 115 Vac to a high frequency for driving discharge lamp loads such as neon or fluorescent lamps with a limited and relatively constant sinusoidal drive current; thereby making it possible to replace the costly and heavy low frequency ballast circuit typically employed in starting and driving discharge lamps with a light-weight, inexpensive, highly efficient, low cost circuit. The invention circuit is particularly suited for use in driving neon lamps requiring several thousands of volts and currents in the tens of milliamps for sign illumination applications as well as HID lamps of both the high and low pressure sodium types having ratings of 50 to 500 watts.

2. Description of the Prior Art

Some presently known high frequency ballast circuits such as that discussed in "Design of Solid-state Power Supplies" by Eugene R. Hnatek, pg 470, Van Nostrand, 1981 typically use high-Q resonant circuits in shunt with the discharge lamp load for the purpose of developing a voltage across the lamp sufficient in amplitude to start the lamp. Circuits of this type are sensitive to the quality and tolerance of components used in their construction. The circuit in the Hnatek reference is substantially similar to the present invention circuit in that the invention ballast circuit forms a tuned tank in parallel with the lamp load for the purpose of developing a voltage high enough to start the lamp. The invention circuit achieves resonance and develops a high voltage sufficient to ionize and start the lamp load. Subsequent to ionization, a lamp load such as a neon lamp provides a damped load to the resonant tank circuit.

SUMMARY OF THE INVENTION

It is a major objective of this invention to provide an efficient, compact, reliable, solid state high frequency ballast circuit for starting and operating discharge lamp loads such as neon and fluorescent lamps as well as a HID lamp load. The invention circuit requires relatively few and relatively inexpensive parts.

It is another objective of this invention to reduce the dependence of the circuit on tightly toleranced components thereby increasing the availability of components and decreasing their respective cost.

It is another object of the invention to use only tightly coupled magnetic components. This approach reduces radiated fields near the circuit and reduces or eliminates unanticipated loading or damping effects due to other nearby apparatus.

It is a more particular objective of this invention to provide repetitive series of drive signals to a series switch to connect a dc voltage source to an inductor, the inductor being connected between the switch and a power oscillator. The duty cycle ratio of the drive signal controls the ratio of the on time to the off time of the series switch. The ratio control of the switch provides control of the power delivered to the lamp load. In addition to providing drive signals, the primary oscillator circuit provides pulses of power of a predetermined amplitude to a neon or fluorescent lamp load until the lamp ionizes and starts.

A particular embodiment of the invention high frequency ballast circuit has first and second power input terminals and first and second power output terminals. The high frequency ballast circuit is powered by an input voltage source of a first polarity coupled between the first and second power input terminals. The high frequency ballast circuit has a starting mode and operating mode for starting and operating a discharge lamp load, such as a neon lamp connected between the first and second power output terminals. The starting mode is characterized by the high frequency ballast circuit operation before ionization of the neon lamp load. The operating mode is characterized by the high frequency ballast circuit operation subsequent to ionization of the neon lamp load.

The high frequency ballast circuit comprises a power oscillator circuit means having power oscillator first and second output terminals for converting power from a dc source to a quasi-sinusoidal drive signal to the discharge lamp load. Driving the load with a near sinusoidal drive voltage reduces conducted and radiated emissions from the circuit. Audible interference on AM radio broadcast programs received by a receiver near the ballast circuit is noticeably diminished by activation of synchronization.

A synchronizing means is provided for synchronizing operation of the series switch with the frequency of the power oscillator.

BRIEF DESCRIPTION OF THE DRAWINGS

FIG. 4 is an end view of the bobbin of T1, FIG. 5 is a side view of the bobbin of T1, FIG. 6 is an expanded side view of a segment of the bobbin of T1, FIG. 7 is a partial expanded side sectional view of a loaded bobbin of T1, FIG. *7a* is an expanded side sectional view of the circle designated sectional of FIG. 7, FIG. 8 is a side sectional view of the bobbin of T1 with a partial sectional view taken along line 8—8.

DESCRIPTION OF THE PREFERRED EMBODIMENT

Figure 1:
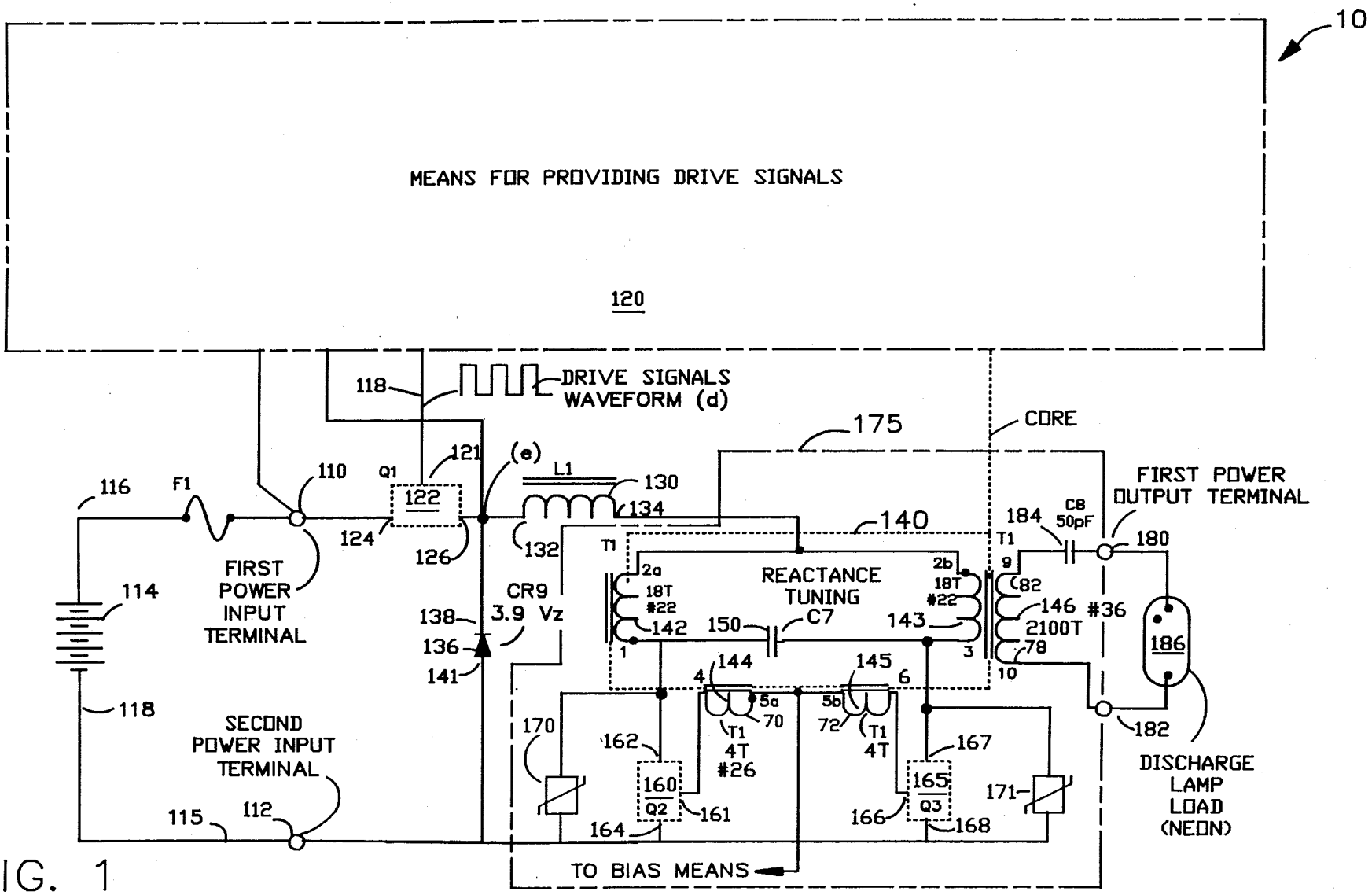
FIG. 1 is a simplified schematic of the invention circuit.

In accordance with the present invention, FIG. 1 is a simplified schematic and block diagram of the invention high frequency ballast circuit 10 having first and second power input terminals 110, 112 and first and second power output terminals, 180, 182. The high frequency ballast circuit is powered by a dc input voltage source, such as 24 Vac source 114 having a positive terminal 116 coupled to the first power input terminal 110 via fuse F1. Dc input voltage source 114 has a negative terminal 118 coupled via conductor 115, to the second power input terminal 112.

The high frequency ballast circuit has a starting mode and an operating mode for starting and operating a gas discharge lamp load such as neon lamp 186 connected between the first and second power output terminals 180, 182, The starting mode is characterized by the high frequency ballast circuit operation before ionization of the gas discharge lamp load 186. The operating mode is characterized by the high frequency ballast circuit operation subsequent to ionization of the lamp load.

Referring to FIG. 1, the invention high frequency ballast circuit 10 comprises a means for providing drive signals for the control of the lamp brightness, such as the circuitry contained within phantom block 120. Each drive signal has a first and second state. referring to FIG. 2, waveform (d) represents a drive signal such as that coupled via signal line 118 in FIG. 1 from phantom block 120 to series switch 122 control terminal 121. The drive signal of waveform (d) has a first state such as a high or logic one state 212 and a second state such as a low or logic zero state 210.

The High Frequency Ballast Circuit series switch Q1 122 in FIG. 1 has a conduction channel with a first and second terminal 124, 126. The first terminal 124 is coupled to the first power input terminal 110. The series switch Q1 has control terminal 121 that is responsive to the drive signals, such as the 12 V waveform (d) of FIG. 2. The conduction channel is on (conductive) in response to the interval characterized by the first state 210 of the drive signal waveform.

FIG. 1 shows the invention circuit having inductor L1 130 with respective first and second terminals 132 and 134. FIG. 1 also shows clamp diode CR9 136 having anode 141 and a cathode 138. The inductor first terminal 132 is coupled to the clamp diode cathode 138 and to the series switch conduction channel second terminal, 126.

FIG. 1 also shows the High Frequency Ballast Circuit 10 having ballast reactance C8 184. This capacitor is selected to have a reactance high enough in value to limit the load current to a predetermined value at operating frequency.

The circuitry within phantom block 175 is meant to represent a power oscillator circuit for providing a quasi-sinusoidal current-limited drive voltage to the discharge lamp load interposed between the high frequency ballast circuit first and second power output terminals 180, 182.

The invention High Frequency Ballast Circuit power oscillator circuit within phantom block 175 includes transformer T1 140 primary winding 142, 143 having a first, terminal T1-1, a second terminal T1-3 and a center-tap terminal T1-2*a*, T1-2*b* respectively. The transformer T1 has a drive winding 144, 145 with a first terminal T1-4, a second terminal T1-6 and a center-tap terminal T1-5*a*, T1-5*b* respectively. Transformer T1 also has an output winding 146 having at least a first terminal T1-9 and a second terminal T1-10. The ballast reactance C8, 184 is coupled in series with the transformer output winding between the High Frequency Ballast Circuit first and second power output terminals.

Capacitor C7, 150 represents a reactance tuning means coupled between the transformer primary winding first and second terminal T1-1 and T1-3.

Phantom blocks 160, 165 represent a first and second semiconductor drive switch. Each drive switch has a control terminal. The control terminal for Q2 is designated by reference number 161 and the control terminal for switch Q3 is designated by reference number 166. The switches are characterized in the broad sense as having a conduction channel such as the conduction channel formed between the drain and source of a field effect transistor (FET) or between the collector and emitter of a bi-polar transistor. In the broad sense, the conduction channel has a first and second terminal. Reference number 162 designates the conduction channel first terminal for Q2 and reference number 167 designates the conduction channel first terminal for Q3. Similarly reference numbers 164 and 168 designate the respective conduction channel second terminals for Q2 and Q3. The conduction channel second terminals are coupled to the clamp diode 141 anode and to the second power input terminal 112.

The transformer primary winding first terminal T1-1 is coupled (connected) to the first drive switch conduction channel first terminal 162. The primary winding second terminal T1-3 is coupled to the second drive switch conduction channel first terminal 167 and the primary winding center-tap designated by T1-2*a* and T1-2*b* is coupled to the inductor second terminal 134. The drive winding first and second terminals T1-4 and T1-6 are respectively coupled to the first and second drive switch control terminals 161, 166.

The high frequency ballast circuit converts dc power coupled from the high frequency ballast circuit first and second power input terminals 110, 112 to a quasi-sinusoidal, current-limited voltage source at a starting output voltage and at a starting frequency applied between the first power output terminal 180 and the second power output terminal 182 during the starting mode. The high frequency ballast circuit also provides a quasi-sinusoidal, predetermined current-limited voltage source at a predetermined operating output voltage and operating frequency applied between the power oscillator first and second output terminals to obtain a predetermined level of lamp load illumination during the operating mode.

Figure 3:
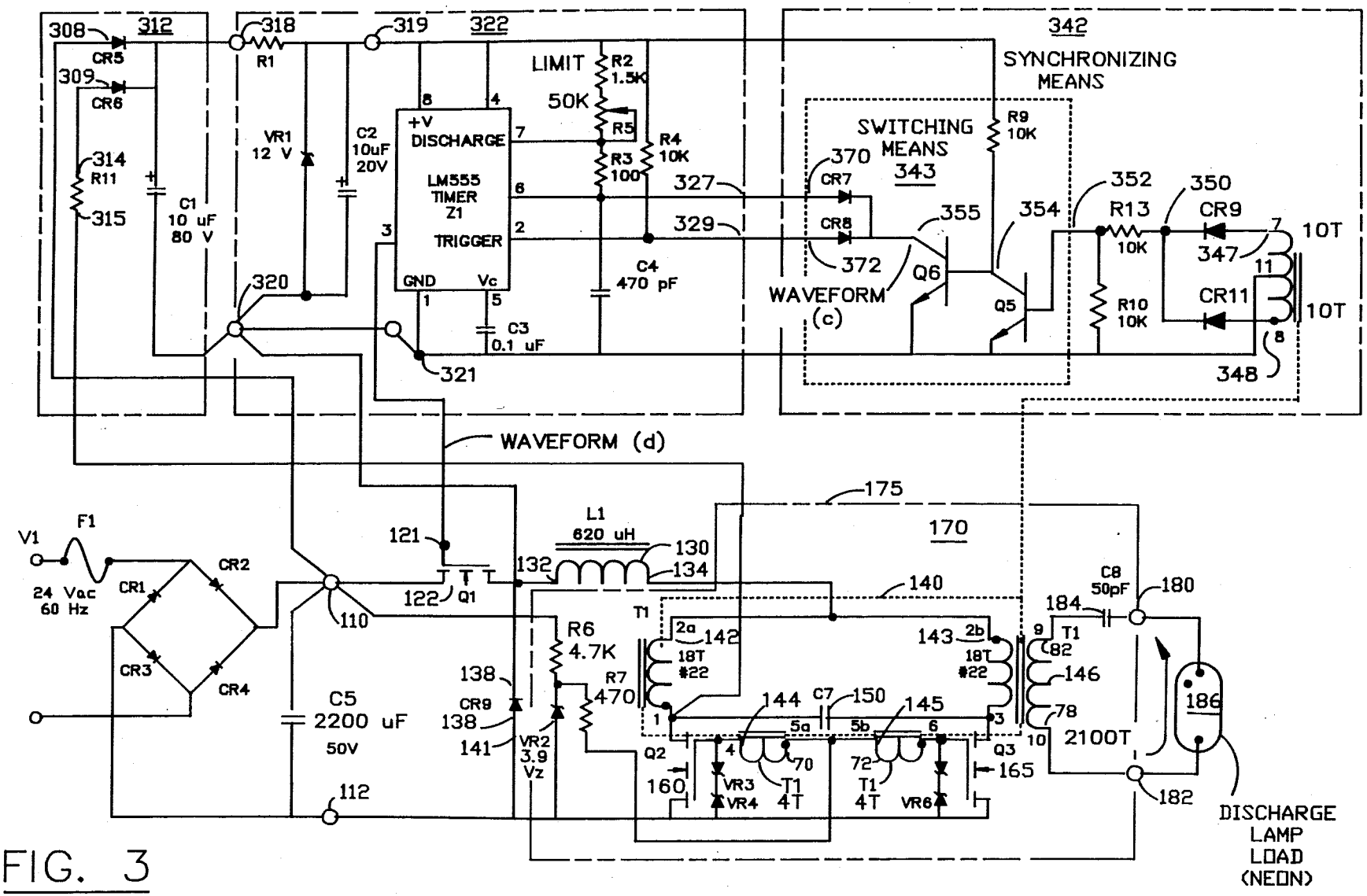
FIG. 3 is a more detailed schematic of an embodiment of the invention circuit.

Referring to FIG. 3, in a more particular embodiment, the means for providing a periodic drive signals 120 shown in FIG. 1 is shown to be comprised of three functional phantom blocks within its perimeter. The first block to be discussed is the timer circuit such as the circuit within phantom block 322 having positive and negative input voltage terminals 318, 320 respectively. This embodiment also has a boosted positive voltage source such as that characterized by the circuit within phantom block 312 for applying a positive voltage between the timer circuit positive input voltge terminal 318 and the timer circuit reference voltage terminal 320.

In another embodiment of the high frequency ballast circuit, the timer reference voltage terminal 320 is connected to the clamp diode cathode 138.

In another alternative embodiment, the timer circuit of phantom block 322 has a means for adjusting the its output drive signal pulse width. Within phantom block 322, selecting the values of the resistor string comprising R2, LR5, R3 and capacitor C4 provides a means for adjusting the output drive signal pulse width occurring after each synchronizing pulse from synchronizing means phantom block 342 via CR7 and CR8 to the LM555 timer Z1. The timer circuit of phantom block 322 is configured as a monostable one-shot multi-vibrator. The output drive signal from Z1-3 will remain in the high state until the timer receives a synchronizing pulse. The Output drive signal drops to a low state in response to the synchronizing pulse and remains low for for an interval determined by the series combination of R2, R5 and R3 charging C4 to a value equal to $\frac{2}{3}$ of the voltage difference between nodes 319 and 321. R5 provides a means for adjusting the pulse width having a range of control that typically extends from a 20% to a 100% duty cycle where the duty cycle is characterized as the ratio of the time the drive signal at Z1-3 is low to the time it is high. An operator adjusts the brilliance of the lamp load by adjusting R5 to obtain a desired level of illumination. Until the power oscillator starts, synchronizing pulses are not available from synchronizing means 342 and the output at Z1-3 remains high applying full voltage from input terminal 110 to L1 via Q1 until the oscillator does start.

The LM555 timer is a well known component for which equivalents are available from many commercial sources such as the National Semiconductor Company of Santa Clara, CA. Values for resistors in the series string of R2, R5, and R3 and the value for C4 are initially determined for a predetermined pulse-width by making reference to a manufacturers application notes for the timer used.

The circuitry within phantom block 342 is an embodiment of a means for synchronizing the timer circuit 322 operating frequency to the operating frequency of the power oscillator circuit 175 for the purpose of minimizing conducted and radiated emissions.

Referring to FIG. 3, the circuitry within phantom block 312 representing a means for providing a boost positive voltage source between the timer circuit positive input voltage terminal 318 and the timer reference voltage terminal 320. The means for providing a boost positive voltage source comprises first and second boost rectifier diodes such as CR5 and CR6. Each boost rectifier diode has a respective anode and a respective cathode.

The boost circuit also has boost filter capacitor C1 having a positive terminal and negative terminal. The negative terminal is coupled to the timing circuit timer reference voltage terminal 320. A current limiting resistor R11 is included and has a first and second terminal 315, 314. The first boost rectifier diode anode 308 is coupled to the high frequency ballast circuit first power input terinal 110. The first and second rectifier diode cathodes are coupled to the boost filter capacitor C1 positive terminal and to the timer circuit positive input voltage terminal 318.

The current limiting resistor first terminal 315 is coupled to the transformer primary winding first terminal T1-1 and the current limiting resistor second terminal 314 is coupled to the second boost rectifier diode anode 309.

In another alternative embodiment, the timer circuit comprises a voltage regulating means, such as a three terminal regulator, not shown, and has an input terminal 318, and a reference terminal 320 coupled to the timing circuit reference voltage terminal 320 and an output terminal 319 for providing a predetermined regulated voltage source referenced to the timer reference voltage terminal 320 to the astable timer circuit positive input voltage terminal.

FIG. 3 shows a ballast reactance C8, 184 for limiting load current. The ballast capacitor has a first terminal coupled to the transformer output winding first terminal, T1-9 and a second terminal coupled to the high frequency ballast circuit first power output terminal 180. The transformer output winding second terminal, T1-10 is connected to the high frequency ballast circuit second power output terminal 182.

Transformer T1 contains a synchronizing winding having a first and second terminal T1-7, 347 and T1-8, 348 and a center-tap terminal T1-11, 349. The synchronizing winding provides an isolated synchronizing signal, i.e. a signal referenced to the timer reference voltage terminal 320.

The synchronizing winding first and second terminals T1-8, T1-7 are alternately coupled via a forward biased diodes (CR9 and CR11) to the first end of resistor R13, 350. Resistor R11 forms a resistor divider with R10 that is terminated at the timer circuit reference voltage terminal 320. R13 is necessary to limit current into the base of Q5. The junction of R13 and R10, 352 is coupled to the input of SWITCHING MEANS 343, contained within phantom block 342 and having outputs at 370, 372. The full-wave rectifier positive terminal 350 provides an absolute sinusoidal synchronizing signal represented by waveform (a) in FIG. 2 to the series combination of R13 and R10.

A bridge rectifier (not shown) can serve as an alternative but less preferable coupling means from the power oscillator to the synchronizing means 342. However, the full wave winding of T1-7, T1-8 and T1-11 is a preferred alternative. The bridge rectifier positive terminal (not shown) would also provide an absolute sinusoidal synchronizing signal such as represented by waveform (a) in FIG. 2.

The synchronizing means of phantom block 342 in FIG. 3 has a SWITCHING MEANS such as the circuit within phantom block 343. The SWITCHING MEANS 343 is responsive to the absolute sinusoidal synchronizing signal of wave form (a) for providing at least a first synchronizing pulse to the timer circuit of phantom block 322. As the absolute sinusoidal synchronizing signal of waveform (a) of FIG. 2, coupled via the series combination of R13 and R10 to the base of Q5, drops below the base to emitter voltage of NPN transistor Q5, Q5 turns off. The collector voltage of Q5 is pulled positive by R9 connected to the regulated source at terminal 319. As the collector of Q5 rises above the base to emitter voltage of Q6, the base to emitter junction of Q6 is forward biased by current from R9 turning on Q6. The collector of Q6 immediately drops to a few tenths of a volt above its emitter voltage.

Figure 2:
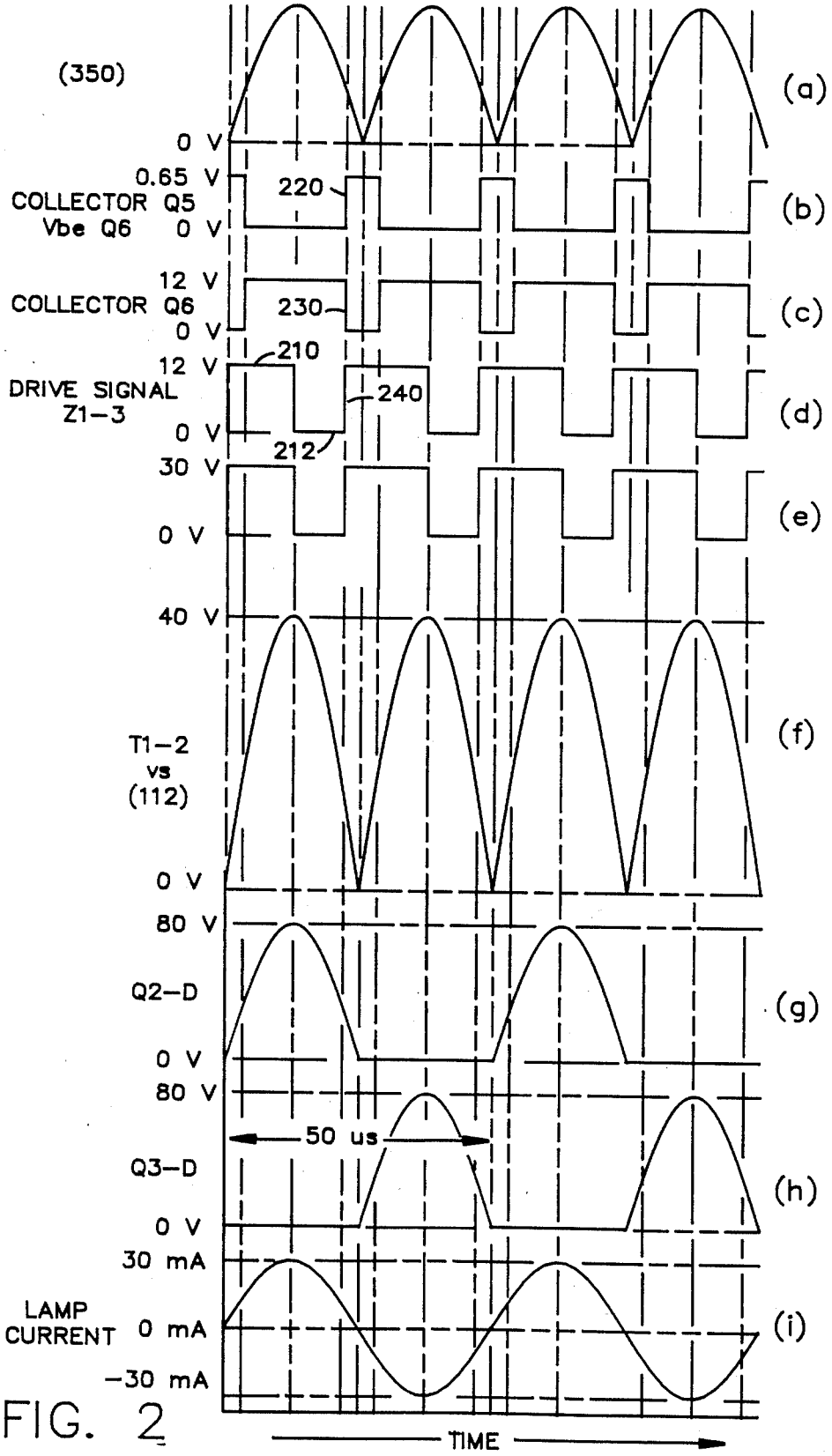
FIG. 2 is a partial timing diagram for the invention circuit.

Waveform (b) in FIG. 2 represents the rise in voltage of the collector of Q5 at 220 while waveform (c) represents the simultaneous drop or fall in voltage at the collector of Q6 at 230. The synchronizing pulse of waveform (c) at 230 is coupled via diodes CR7 and CR8 via synchronizing means outputs 370, 372 to the trigger inputs 327, 329 of the timer circuit 322. As the synchronizing signal of waveform (c) drops at 230, the positive edge of the drive signal is fed from the output of timer circuit at pin Z1-3 to terminal 121. The drive signals from pin Z1-3 to the series switch are represented by waveform (d) at 240. In the absence of synchronizing pulses, the base of Q5 remains grounded forcing Q5 to remain off. Pull up resistor R9 operates to turn on Q6. With Q6 driven into conduction, the synchronizing inputs to Z1 remain low below the $\frac{1}{3}$ limit forcing the output of Z1 at pin 3 to remain high. This feature of the circuit insures that power will be applied to the power oscillator 175 before it starts.

Waveform (d) of FIG. 3 is applied to the gate 121 of the Q1 FET switch shown in FIG. 3. This signal turns the Q1 switch on during the interval that the gate is more positive than the Q1 source connected to the cathode 138 of CR9. Waveform (e) represents the waveshape of the voltage applied to terminal 132 of L1 and to the cathode of CR9 measured with respect to first power input terminal 112. The low state of the waveform (e) is one forward diode drop below the reference potential at the first power input terminal 112. As the Q1 switch opens, L1 operates as a power source and develops the required voltage between T1-2 and the cathode of CR9.

Referring to FIG. 3, components R6, R7 and VR2 represent a means for providing a bias voltage to the drive switch control terminals during the starting mode. These components form a bias regulator having an input terminal connected to the power input terminal 110, a reference terminal connected to the second power input terminal 112 and a bias voltage output terminal connected to T1-5.

The resistor divider has a first and second resistor R6, R7 connected in series at a common terminal. A first terminal of the first resistor is connected to the first power input terminal 110. The common terminal between R6 and R7 is connected to the cathode of zener regulator VR2. The anode of VR2 is connected to the second High Frequency Ballast Circuit power input terminal 112. The bias voltage output terminal is connected to T1-5a and T1-5*b*. The resistor divider first and second resistors R6, R7 and VR2 are selected to bias the first and second semiconductor drive switch control terminals to a voltage sufficient to obtain partial conductivity of both conduction channels to permit the power oscillator to start.

A rectifier filter means comprising CR1 thru CR4 and capacitor C5 is coupled to the first and second power input terminals at 110 and 112 and provides an unregulated voltage source having a first polarity with respect to the second power input terminal to the bias regulator formed by R6 R7 and VR2.

FIG. 1 and 3 show first and second semiconductor drive switches as respective first and second n-channel, insulated gate field effect transistors Q2 and Q3. Each transistor gate is coupled as a control terminal for the respective switch. Each transistor source is coupled as a conduction channel first terminal and each transistor drain serves as conduction channel second terminal.

Figure 9:
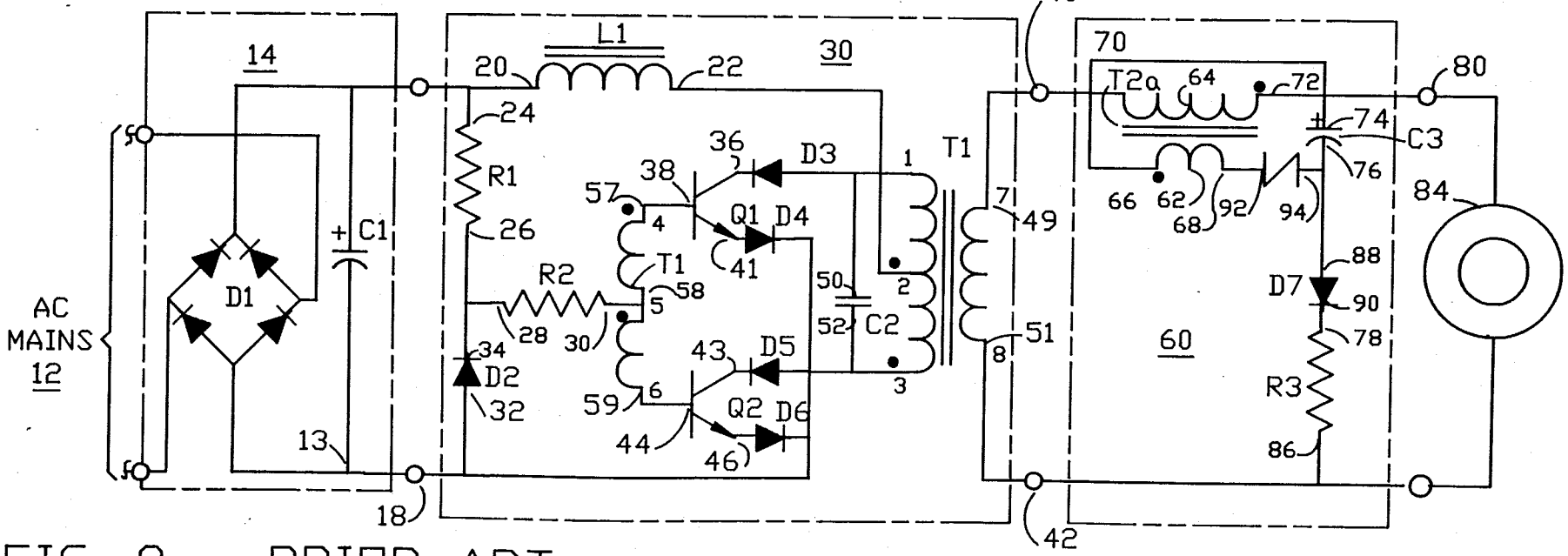
FIG. 9 PRIOR ART
FIG. 9 is a schematic of a PRIOR ART power oscillator circuit.

It is understood that the first and second semiconductor drive switches can comprise, in the alternative, respective first and second NPN transistors such as those shown in the PRIOR ART circuit ot FIG. 9 from U.S. Pat. No. 4,572,988, by Handler and Wilison, titled High Frequency Ballast Circuit and issued Feb. 25, 1986. Referring to FIG. 3, substituting NPN bi-polar transistors for switches Q2 and Q3 (not shown) will require that each NPN transistor base be connected as the control terminal for the respective switch and each collector be connected as a conduction channel first terminal. Each emitter must be connected as a conduction channel second terminal.

OPERATION OF THE CIRCUIT

Referring to FIG. 3, the high frequency power oscillator of Q2 and Q3 is specifically designed for powering gas discharge lamps such as neon or other cold cathode tubes. Other gas discharge type lighting, such as fluorescent, high pressure and low pressure sodium and other similar devices could be powered by the circuit of FIG. 3 with some modification to operating voltages and currents.

The invention circuit is made up of three functional blocks. These blocks comprise: 1. an input rectifier filter; 2. a power oscillator circuit, and 3. a synchronous preregulator.

INPUT RECTIFIER FILTER

The input rectifier filter is designed by establishing what the maximum output power will be and what the maximum and minimum operating voltage will be on capacitor C5. The ripple voltage at the first power input terminal 110 is typically used to establish what value must be assigned to the ac current circulating in capacitor C5. Manufacturers stress derating limits must be observed in selecting C5 for both 120 Hz ripple and for ac current circulating at the frequency of the power oscillator when switch Q1 is closed. The values of peak surge current and the value of ac current passing thru the bridge rectifier CR1–CR4 will determine what diodes should be selected for that application. Silicon rectifiers such as the 1N5400 are suitable for the circuit of FIG. 3 while operating a lamp at a power level of 30 watts. For a further discussion of the design of the rectifier filter, the reader is referred to chapter 3 of "Electronic Transformers and Circuits", 2nd Ed., by Ruben Lee, 1955 in which the author provides a discussion and republishes on pages 64 through 68 curves from "Analysis of Rectifier Operation," by O. H. Schade, Proc. I.R.E., 31, 341 (July 1943).

POWER OSCILLATOR OPERATION

Transformer T1, Capacitor C7, FETS Q2 and Q3 and inductor L1 make up the basic oscillator circuit. Operation of this circuit will be explained in connection with waveforms (f), (g), (h) and (i) of FIG. 2. The bias supply of R6–R7 and VR2 provides a regulated 3.9V source to the gates of Q2 and Q3. Once operating, drive winding T1-4, 5, 6 5 operates with low impedance and masks the presence of the bias circuit. For a further discussion of the design of zener regulator circuits such as the circuit of VR1 and VR2 in FIG. 3, the reader is referred to chapter 6 in the "Motorola Zener Diode Manual", 1980 from Motorola Inc. of 10 Phoenix, Ariz. or the "International Rectifier Corporation Zener Diode Handbook", 1966, from International Rectifier at El Segundo, Calif.

The voltage across the primary of the transformer T1 terminals T1-1 and T1-3 is approximately 160 volts peak-to-peak and with a frequency of 25 Khz. The voltage between these nodes is quasi-sinusoidal. Waveform (f) represents the waveshape of the voltage at the centertap T1-2 measured with respect to the second power input terminal 112. This voltage is approximately 40 volts peak to peak and has a frequency of 50 Khz.

The voltage across the power output winding (the secondary) T1-9 to T1-10 is quasi-sinusoidal or nearly sinusoidal and is typically 9300 volts peak-to-peak or 3300 volts RMS ac. Capacitor C8 is a low ESR capacitor such as a Sprague, polypropelene 7GAQ47 capacitor rated for 7.5 KV from the Sprague company of Mass.

This component is selected to have an impedance at the operating frequency sufficiently high to limit the lamp current to a value consistent with the illumination required from the lamp load.

The center taped bias drive winding between T1-4 and T1-8 provides a sufficient drive voltage to the gates of Q2 and Q3 to turn these switches on hard when positive with respect to the second power input terminal 112 thereby sustaining oscillation. The center taped synchronizing winding T1-7 to T1-11 to T1-8 is isolated because the synchronizing circuit operates with respect the reference voltage at timer reference terminal 321.

The voltage at this terminal is switching from a level established by terminal 112 to the voltage level established by the rectifier filter at 110 as FET Q1 turns on and off. The isolated synchronizing winding makes it possible to synchronize the drive signal to the gate of Q1 with the power oscillator operating frequency thereby reducing subharmonics in the radiated and conducted emissions of the invention circuit.

SYNCHRONIZING CIRCUIT OPERATION OF THE PRE-REGULATOR

The switch Q1, the inductor L1 and the clamp diode CR9 form a preregulator for synchronization with the power oscillator 175. The drive signal to the gate of Q1 is accomplished with a series pulse-width regulator. Z1 is a conventional LM555 timer circuit from Signetics. It is configured as a retrigerable one-shot multivibrator. Pin Z1-3 provides an output signal such as waveform (d) that directly drives the gate of Q1 to turn it on when the waveform is positive. Diode CR9 is a catch diode that provides a current path for the power oscillator current during the interval that the Q1 switch is off. Variable resistor R5 represents a means for adjusting the on time of the Z1-3 output signal via the combination of values of R2, R5, R3 and C4. Selection of these values for a particular application is aided by referring to the "Linear Databook" by the National Semiconductor Corporation, of Santa Clara, CA, 95051, 1982, pages 9–33 and subsequent. Since the timing circuit is configured as a one-shot, it requires a continuous series of trigger pulses to perform its timing function. Transformer winding T1-7, T1-11 to T1-8 is isolated and drives diodes CR9 and CR11 to provide a positive series of half cycle sine waves.

The signal from the full-wave rectifier drives the Q5 switch. R10 limits the current into the base of Q5. A series of positive pulses are produced at the collector of Q5 that correspond to the zero crossing of the oscillator. Q4 inverts the pulses to obtain the pulse polarity required by the LM555 timer. Isolation diodes CR7 and CR8 allow Q6 to simultaneously discharge capacitor C4 via CR7 and to also pull pin 6 low. The trigger pulse allows the LM555 to respond as a retriggered one-shot.

Referring to FIG. 3, in a more particular alternative embodiment of the high frequency ballast circuit, the timer circuit further comprises an LM555 type timer circuit having a discharge pin input (pin 7), a threshold pin input (pin 6) and a trigger pin input (pin 2). A a limit resistor such as R2 has a first and second terminal. The first terminal is connected to the timer positive input voltage terminal, i.e. node 319. An adjustable resistor R5 has a first and second terminal and a wiper terminal common to the second terminal of R5. The first terminal is conenected to the limit resistor R2 second terminal.

The timer circuit also has a discharge limit resistor, such as R3. R3 has a first and second terminal. The first terminal is connected to the second terminal of the adjustable resistor R5 and to the trigger input pin 2 of the 555 timer IC.

A pull-up resistor R4 has a first terminal connected to the timer positive input voltage terminal 319 and the second terminal is connected to the trigger input pin.

The timing capacitor C4 has a first terminal connected to the threshold pin and to the second terminal of the discharge limit resistor R3.

The switching means 343 has a first and second switching diode such as CR7 and CR8. Each diode has a respective anode and cathode. The switching means also has an input and output transistor. Each respective transistor has a collector, base and emitter.

The first switching diode CR7 anode is connected to the threshold pin 6. The second switching diode CR8 anode is connected to the trigger pin 2. The first and second switching diode cathodes are connected to the collector of the output transistor Q6. The emitters of the output and input switching means transistors are connected to the timer circuit reference voltage terminal 320.

An input pull-up resistor R9 has a first and second terminal. The first terminal is connected to the timer circuit input voltage terminal 319 and the second terminal is connected to the collector of the input transistor Q5 and to the base of the output transistor, Q6. The base of the input transistor Q5 is connected to the junction of the synchronizing resistor divider first and second resistors.

R5 is adjusted to cause the 555 and switch Q1 to remain continuously on. This occurs when the RC time constant of the R2, R5, R3 and C4 component group is longer than the time between trigger pulses and the voltage at Z1-6 fails to rise to the $\frac{2}{3}$ VCC limit established by the internal divider within the LM555. A failure of the voltage to rise to the $\frac{2}{3}$ threshold results in the output logic state of the LM555 remaining unchanged or high in this case. The LM555 drive signal to the gate of the Q1 switch has an amplitude of +12 volts measured with respect to the source of Q1.

The power to operate the LM555 is initially provided via the anode of CR5 as voltage develops input terminal 110. Q1 is initially commanded on because Z1-6 is low with respect to Z1-1. The voltage on capacitor C1 is boosted with each cycle of the power oscillator via R11 and CR6. Zener regulator operates in cooperation with R1 and the voltage on C1 to apply a regulated 12 volts to the +V power input of the LM555.

Under normal operating conditions, a system operating with a 24 Vrms, 60 Hz source providing dc voltage to the bridge of CR1–CR4 produces a typical voltage across the Q1 switch of 30 volts peak at turn on. This difference is coupled via CR5 to set the voltage on the capacitor C1.

A full on condition for the Q1 FET results when the dimmer control R5 is adjusted for maximum illumination. Under this operating condition, the peak signal swing at the source of Q1 reaches 40 volts peak measured with respect to the second power input terminal 112.

The zener diodes VR3 and VR4 prevent the voltage swing at the gate of Q2 from exceeding the gate to source breakdown voltage of FET Q2 and diodes VR5 and VR6 prevent the voltage swing at the gate of Q3 from exceeding the gate to source breakdown voltage of FET Q3. These zener diodes have breakdown values selected to be of sufficient magnitude to prevent the gate to source voltage from exceeding the limits specified by the manufacturer of the FETs.

Transformer T1 is designed to tightly couple the primary to all secondaries. This reduces radiated electromagnetic interference and enables the circuit to be mounted in a metal case without substantial loading of the circuit. The operating frequency of the power oscillator is substantially determined by the values of the T1 magnetizing inductance and the value of the C7 capacitor and to a lesser extent by the reflected value of capacitor C8 in series with the discharge lamp load.

In an alternative embodiment of the invention ballast circuit, the power oscillator circuit 170 is characterized to have a transformer having an output winding having a first and second terminal such as T1-9 and T1-10 coupled to respective power oscillator first and second 180, 182 terminals. The transformer secondary is wound on a multi-segment segment segmented bobbin such as that shown in FIGS. 4 and 5. FIG. 8 shows the bobbin having an axial hole through an insulating cylinder for receiving a core legs from opposing ends. FIG. 8 also shows a plurality of circular bobbin segments formed by insulating rings. Each ring has a hole, and the rings are concentrically positioned on planes normal to the axis of the cylinder.

Figure 10:
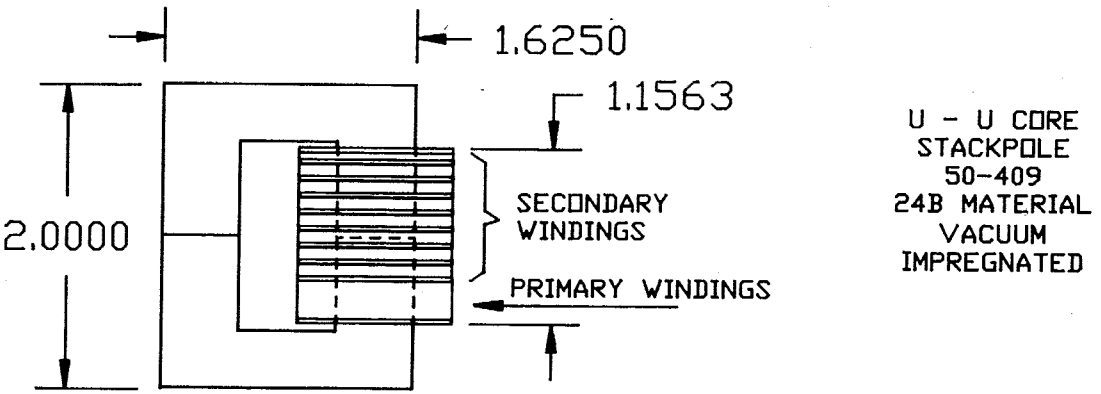
FIG. 10 is a plan view of transformer T1.

FIG. 10 shows the filled bobbin mounted on a U—U core pair. Care must be exercised in planing the location an method of bringing leads out of the bobbin to reduce voltage stress on the insulation systems.

The insulating rings are spaced at predetermined distances along the longitudinal axis of the cylinder. Bobbin segment window spacing was set to 0.080 inches on a test bobbin as shown in FIG. 5. A window width of 0.080 inches was tested and found to be acceptable for receiving secondary wire turns.

FIG. 6 and 8 show that each insulating ring has a relatively thin diagonal slot, such as 410 cut from the outer perimeter of the insulating ring to the inner perimeter of the insulating ring hole to form an exit passage for wire at the surface of the cylinder at 815. The secondary has a series of multiple turn winding segments distributed into at least two of the bobbin segments formed by consecutive insulating rings. FIG. 8 depicts two adjacent bobbin segments filled with corresponding wire segments. The wire forming the last turn of a winding segment at the top of a bobbin segment 811 is passed via the relatively thin diagonal slot to enter the next subsequent bobbin segment at 815 as the initial turn in a subsequent winding segment.

The core of T1 is a conventional U-U Core of material type 24B by Stackpole having a gap of approximately 0.015 inches in each leg. Use of the segmented bobbin provides a means for limiting the voltage gradient between segments. The coil and core assembly is vacuum impregnated for applications requiring secondary voltages of 500 volts or more to eliminate the breakdown of insulation systems including the wire insulation, breakdown of the bobbin between segments, breakdown from the winding through the bobbin to the core and breakdown from layer to layer within winding segments.

FIGS. 4 through 8 are and 10 show the claimed features of transformer T1. The end view of the bobbin, having a cylinder for receiving the leg of a core such as the Stackpole ferrite U core 50-0409, is shown in FIG. 4. Prototype bobbins have been made of machined nylon. Other materials such as fiberglass should also be acceptable. The lamp load used in testing the invention circuit was 10 feet of 0.51 inch outside diameter, 4500 white neon from Voltarc Tubes, Inc., Fairfield, CT 06430-0688 operating with 10 millimeters of mixed gas pressure. The tube used for the load is of a type conventionally employed in fabricating neon signs for display use. Lamp loads such as these are available from suppliers such as the Montroy Supply Co., 4165 Beverly Blvd., Los Angeles, CA, 90004. A load of this character typically operates with 9300 volts peak-to-peak across its length.

The high voltage required across the secondary of T1 in combination with the high frequency of operation, i.e. 25 KHz, was found to rapidly degrade the bobbin and insulation system. It was discovered that it was necessary to limit the voltage between segments, such as segment 408 in FIG. 6 by winding only a limited predetermined number of turns in each bobbin segment. This assembly step alone was insufficient to eliminate breakdown of the insulation system. It was also necessary to slit each segment as shown in FIG. 6 and as shown in FIG. 8 in section.

Referring to FIG. 7, and FIG. *7a* expanding on region 720, each window is filled with a bundle of turns 710 using layer winding on a winding machine. The bottom layer is installed first and the top layer 708 last. On completion of each bundle, in conventional practice, the machine drags the wire across the top of the segment insulator from 712 to 714 and down to the bottom of the segment at 716. The machine then proceeds to fill the segment until the wire layers reach the height of 714 in the window. The length of wire from 712 to 716 is at a single potential. Each of the turns in the segment window at the left adds an additional potential difference between itself and the wire from 714 to 716 thereby insuring maximum stress on the wire insulation system at this level.

Referring to FIG. 8, layers are loaded by machine into the bobbin window in the conventional manner from a lower layer 809 to the top layer 808. In the subject invention, the lead is then passed from the top layer at 811 to the base of the right segment window at 815 via slit 410 shown in FIG. 6. As the wire lead traverses this path, its insulation system obtains the greatest benefit from the wall thickness at the top between 811 and 813 where it is needed and the minimum benefit at the base where the stress levels are least. This construction feature is incorporated into the invention circuit to obtain increased reliability, extended life and higher yield. It is also necessary to vacuum impregnate the assembled core and coil assembly to avoid insulation failure of the bobbin to the core and from bobbin segment to bobbin segment, i.e. from window to window.

I claim:

1. A high frequency ballast circuit having first and second power input terminals and first and second power output terminals, said high frequency ballast circuit being powered by a dc input voltage source of having a positive terminal coupled to said first power input terminals and a negative terminal coupled to said second power input terminal, said high frequency ballast circuit having a starting mode and operating mode for starting and operating a gas discharge lamp load connected between said first and second power output terminals, said starting mode being characterized by said high frequency ballast circuit operation before ionization of said gas discharge lamp load, said operating mode being characterized by said high frequency ballast circuit operation subsequent to ionization of said gas discharge lamp load, said high frequency ballast circuit comprising:

a means for providing drive signals, each said drive signal having a first and second state and an adjustable duty cycle ratio, the sum of the time required for a drive signal first state followed by a drive signal second state characterizing the timer period, and the time for a drive signal first state divided by the respective timer period characterizing said duty cycle ratio, a series switch having a conduction channel having a first and second terminal, said first terminal being coupled to said first power input terminal, said series switch having a control terminal responsive to said drive signals, said conduction channel being on (conductive) in responsive to the interval characterized by the first state of said drive signal and off (non-conductive) in response to a drive signal having a second state, an inductor having a first and second terminal; and a clamp diode having an anode and a cathode, said inductor first terminal being coupled to said clamp diode cathode and to said series switch conduction channel second terminal;

a ballast reactance;

a power oscillator circuit for providing a quasi-sinusoidal current-limiited drive voltage to said discharge lamp load interposed between said high frequency ballast circuit first and second power output terminals, said power oscillator circuit having;

a transformer having, a primary winding having a first, a second and a center-tap terminal, a drive winding having a first, a second and a center-tap terminal, and an output winding having at least a first and second terminal, said ballast reactance being coupled in series with said transformer output winding between said first and second power output terminals, a reactance tuning means coupled between said transformer primary winding first and second terminal, a first and second semiconductor drive switch, each drive switch having a control terminal and a conduction channel having a first and second terminal, said conduction channel second terminals being coupled to said clamp diode anode and to said second power input terminal, said primary winding first terminal being coupled to said first drive switch conduction channel first terminal, said primary winding second terminal being coupled to said second drive switch conduction channel first terminal and said primary winding center-tap being coupled to said inductor second terminal;

said drive winding first and second terminal being respectively coupled to said first and second drive switch control terminals;

whereby, said high frequency ballast circuit is characterized to convert dc power coupled from said high frequency ballast circuit first and second power input terminals to a quasi-sinusoidal, current-limited voltage source at a starting output voltage and at a starting frequency applied between said first power output terminal and said second power output terminal during said starting mode and for, providing a quasi-sinusoidal, current-limited voltage source at an operating output voltage and at a operating frequency applied between said power oscillator first and second output terminals during said operating mode.

2. The high frequency ballast circuit of claim 1 wherein said means for providing a periodic drive signal further comprises:

a boost circuit means having, a power output terminal and an output reference voltage terminal for providing a dc source voltage between said power output terminal and said reference voltage terminal, a timer circuit having, a positive input voltage terminal coupled to said boost circuit power output terminal and, a timer circuit reference voltage terminal, said timer circuit reference voltage terminal being coupled to said boost circuit output reference voltage terminal, and;

an output terminal, said timer circuit operating from power received from said boost circuit means applied between said positive input voltage terminal and said timer circuit reference voltage terminal to provide said drive signals to said series switch control terminal, means for adjusting the duty cycle ratio of said timer circuit.

3. The high frequency ballast circuit of claim 2 wherein said timer circuit means negative reference voltage terminal is coupled to said clamp diode cathode.

4. The high frequency ballast circuit of claim 3 wherein said free running timer circuit further comprises:

a synchronizing means for synchronizing said timer circuit timer period to the half-cycle period of said power oscillator.

5. The high frequency ballast circuit of claim 4 wherein said bias means for providing a bias voltage to the drive switch control terminals during said starting mode further comprises:

a bias regulator having an input terminal connected to said first power input terminal, a reference terminal connected to said second power input terminal and a bias voltage output terminal; a bias resistor having a first and second terminal, said bias resistor being connected between said bias voltage output terminal and said transformer drive winding center tap, said bias resistor having a value selected to bias said first and second semiconductor drive switch control terminals to a voltage sufficient to obtain partial conductivity of both conduction channels.

6. The high frequency ballast circuit of claim 4 wherein said synchronizing means further comprises:

a synchronizing winding on said transformer having, a first terminal, a second terminal and a center-tap terminal connected to said timer circuit reference voltage terminal, for providing a synchronizing signal referenced to said timer circuit reference voltage terminal, a first and second synchronizing diode, each respective synchronizing diode having a respective anode and cathode, said synchronizing winding first terminal being coupled to said first synchronizing diode anode, said synchronizing winding second terminal being coupled to said second synchronizing diode anode, a synchronizing resistor divider having a first and second resistor connected in series, each said resistor having a first and second terminal, said second resistor second terminal being coupled to said timer circuit reference voltage terminal, said first resistor being connected to said said first and second synchronizing diodes cathodes, and a switching means responsive to a synchronizing signal at the junction of said synchronizing resistor divider for providing a synchronizing signal to said timer circuit to synchronize said timer circuit timer period to the half-cycle period of said power oscillator.

7. The high frequency ballast circuit of claim 6 wherein said timer circuit further comprises an LM555 type timer circuit having a discharge pin input (pin 2), a threshold pin input (pin 6) and a trigger pin input (pin 2) and;

a limit resistor having a first and second terminal, said first terminal being connected to said timer positive input voltage terminal, an adjustable resistor having a first and second terminal and a wiper terminal common to said second terminal, said first terminal being connected to said limit second terminal, a discharge limit resistor having a first and second terminal, said first terminal being connected to the second terminal of said adjustable resistor and to said discharge input pin, a pull-up resistor having a first terminal connected to said timer positive input voltage terminal and said second terminal connected to said trigger input pin, a timing capacitor having a first terminal connected to said threshold pin and to the second terminal of said discharge limit resistor, and wherein said switching means further comprises a first and second switching diode, each having a respective anode and cathode and an input and output transistor, each respective transistor having a collector, base and emitter;

said first switching diode anode being connected to said threshold pin, said second switching diode anode being connected to said trigger pin, said first and second switching diode cathodes being connected to the collector of said output transistor, the emitters of said output and input switching means transistors being connected to said timer circuit reference voltage terminal, and an input pull-up resistor having a first and second terminal, said first terminal being connected to said timer circuit input voltage terminal and said second terminal being connected to the collector of said input transistor and to the base of said output transistor, the base of said input transistor being connected to the junction of said synchronizing resistor divider first and second resistors.

8. The high frequency ballast circuit of claim 3 wherein said a means for providing a boost positive voltage source between said timer circuit positive input voltage terminal and said timer circuit reference voltage terminal further comprises:

a first and second boost rectifier diode, each boost rectifier diode having a respective anode and a respective cathode;

a boost filter capacitor having a positive and negative terminal, said capacitor negative terminal being coupled to said timing circuit reference voltage terminal;

a current limiting resistor having a first and second terminal;

said first boost rectifier diode anode being coupled to said high frequency ballast circuit first power input terminal and said first and second rectifier diode cathodes being coupled to said boost filter capacitor positive terminal, terminal;

said current limiting resistor first terminal being coupled to said transformer primary winding first terminal and said current limiting resistor second terminal being coupled to said second boost rectifier diode anode.

9. The high frequency ballast circuit of claim 2 wherein said free running timer circuit further comprises:

a voltage regulating means having an input terminal, a reference terminal coupled to said free running timing circuit reference voltage terminal and an output terminal for providing a predetermined regulated voltage source referenced to said reference voltage terminal to said astable timer circuit positive input voltage terminal.

10. The high frequency ballast circuit of claim 1 wherein said ballast reactance for limiting load current further comprises:

a ballast capacitor having a first and second terminal, said ballast capacitor being interposed between said transformer output winding first terminal and said high frequency ballast circuit first power output terminal, said transformer output winding second terminal being coupled to high frequency ballast circuit second power output terminal.

11. The high frequency ballast circuit of claim 1 wherein said first and second semiconductor drive switches further comprise:

respective first and second n-channel, insulated gate field effect transistors, each transistor gate being coupled as said control terminal, each transistor source being coupled as a conduction channel first terminal and each transistor drain being coupled as a conduction channel second terminal.

12. The high frequency ballast circuit of claim 1 wherein said first and second semiconductor drive switches further comprise:

respective first and second NPN transistors, each transistor base being coupled as said control terminal, each collector being coupled as a conduction channel first terminal and each emitter being coupled as a conduction channel second terminal.

13. A high frequency ballast circuit having first and second power input terminals and first and second power output terminals, said high frequency ballast circuit being powered by a dc input voltage source of having a positive terminal coupled to said first power input terminals and a negative terminal coupled to said second power input terminal, said high frequency ballast circuit comprising:

a means for providing drive signals, each said drive signal having a first and second state and an adjustable duty cycle ratio, the sum of the time required for a drive signal first state followed by a drive signal second state characterizing the timer period, and the time for a drive signal first state divided by the respective timer period characterizing said duty cycle ratio, a series switch having a conduction channel having a first and second terminal, said first terminal being coupled to said first power input terminal, said series switch having a control terminal responsive to said drive signals, said conduction channel being on (conductive) in responsive to the interval characterized by the first state of said drive signal and off (non-conductive) in response to a drive signal having a second state, an inductor having a first and second terminal; and a clamp diode having an anode and a cathode, said inductor first terminal being coupled to said clamp diode cathode and to said series switch conduction channel second terminal;

a ballast reactance;

a power oscillator circuit having a positive input terminal coupled to said inductor second terminal a reference terminal coupled to said high frequency ballast circuit second power input terminal, and first and second output terminals connected to said high frequency ballast circuit first and second power output terminals, for providing a quasi-sinusoidal current-limited drive voltage to said discharge lamp load interposed in series with said ballast reactance between and said high frequency ballast circuit first and second power output terminals.

14. The high frequency ballast circuit of claim 13 wherein said reactance means is a capacitor and said power oscillator circuit is characterized to provide said quasi-sinusoidal current-limited drive voltage to said discharge lamp load between and said high frequency ballast circuit first and second power output terminals at voltages above 500 volts peak-to-peak.

15. The high frequency ballast circuit of claim 13 wherein said reactance means is a capacitor and said power oscillator circuit is characterized to have a transformer having an output winding having a first and second terminal coupled to respective power oscillator first and second terminals, said transformer secondary being wound on a segmented bobbin, said bobbin having an axial hole through an insulating cylinder for receiving core legs from opposing ends and a plurality of circular segments formed by insulating rings concentrically positioned on planes normal to the axis of said cylinder, said insulating rings being spaced at predetermined distances to form said segments for receiving secondary wire turns, each insulating ring having a relatively thin diagonal slot cut from its outer perimeter to its inner hole to form an exit at the surface of said cylinder, said secondary having a series of multiple turn winding segments distributed into at least two said bobbin segments formed by consecutive insulating rings, the wire forming the last turn of a winding segment at the top of bobbin segment being passed via said relatively thin diagonal slot to said enter as the initial turn in a subsequent winding segment.

16. The high frequency ballast circuit of claim 15 wherein said segmented bobbin cylinder and circular segments are formed from an integral piece of insulative material.

17. The high frequency ballast circuit of claim 15 wherein said means for providing a periodic drive signal further comprises:

a boost circuit means having, a power output terminal and an output reference voltage terminal for providing a dc source voltage between said power output terminal and said reference voltage terminal, a timer circuit having, a positive input voltage terminal coupled to said boost circuit power output terminal and, a timer circuit reference voltage terminal, said timer circuit reference voltage terminal being coupled to said boost circuit output reference voltage terminal, and;

an ouput terminal, said timer circuit operating from power received from said boost circuit means applied between said positive input voltage terminal and said timer circuit reference voltage terminal to provide said drive signals to said series switch control terminal, means for adjusting the duty cycle ratio of said timer circuit.

18. The high frequency ballast circuit of claim 17 wherein said timer circuit means negative reference voltage terminal is coupled to said clamp diode cathode.

19. The high frequency ballast circuit of claim 18 wherein said free running timer circuit further comprises:

a synchronizing means for synchronizing said timer circuit timer period to the half-cycle period of said power oscillator.

20. The high frequency ballast circuit of claim 19 wherein said a means for providing a boost positive voltage source between said timer circuit positive input voltage terminal and said timer circuit reference voltage terminal further comprises:

a first and second boost rectifier diode, each boost rectifier diode having a respective anode and a respective cathode;

a boost filter capacitor having a positive and negative terminal, said capacitor negative terminal being coupled to said timing circuit reference voltage terminal;

a current limiting resistor having a first and second terminal;

said first boost rectifier diode anode being coupled to said high frequency ballast circuit first power input terminal and said first and second rectifier diode cathodes being coupled to said boost filter capacitor positive terminal, terminal;

said current limiting resistor first terminal being coupled to said transformer primary winding first terminal and said current limiting resistor second terminal being coupled to said second boost rectifier diode anode.

* * * * *